US007637081B2

(12) United States Patent
Murakami et al.

(10) Patent No.: US 7,637,081 B2
(45) Date of Patent: Dec. 29, 2009

(54) ARTICLE STORAGE DEVICE

(75) Inventors: Toshiyuki Murakami, Sagamihara (JP); Motonari Niikura, Chiyoda-ku (JP)

(73) Assignee: Niikura Scales Co., Ltd., Tokyo (JP)

( * ) Notice: Subject to any disclaimer, the term of this patent is extended or adjusted under 35 U.S.C. 154(b) by 685 days.

(21) Appl. No.: 10/557,889

(22) PCT Filed: Aug. 26, 2004

(86) PCT No.: PCT/JP2004/012705

§ 371 (c)(1),
(2), (4) Date: Nov. 18, 2005

(87) PCT Pub. No.: WO2005/021386

PCT Pub. Date: Mar. 10, 2005

(65) Prior Publication Data

US 2006/0274979 A1 Dec. 7, 2006

(30) Foreign Application Priority Data

Aug. 27, 2003 (JP) ..... 2003-302744

(51) Int. Cl.
*B65B 43/38* (2006.01)

(52) U.S. Cl. ..... 53/384.1; 53/572

(58) Field of Classification Search ..... 53/384.1, 53/459, 468, 469, 570, 571, 572
See application file for complete search history.

(56) References Cited

U.S. PATENT DOCUMENTS 3,468,100 A 9/1969 Rubel ..... 53/189
3,727,374 A * 4/1973 Williams ..... 53/572
3,889,449 A * 6/1975 Membrino ..... 53/572
3,897,676 A * 8/1975 Membrino ..... 53/572
3,948,015 A * 4/1976 Lerner ..... 53/459
4,250,694 A * 2/1981 Rochman ..... 53/572
4,368,608 A * 1/1983 Ray ..... 53/572
4,541,228 A * 9/1985 Petersen ..... 53/572

(Continued)

FOREIGN PATENT DOCUMENTS

EP 0 657 357 A1 6/1995

(Continued)

OTHER PUBLICATIONS

Japanese Office Action dated Nov. 30, 2005 received on corresponding Japanese application; 6 pages with English translation.

(Continued)

*Primary Examiner*—Louis K Huynh
(74) *Attorney, Agent, or Firm*—Kratz, Quintos & Hanson, LLP

(57) ABSTRACT

A commodity containing apparatus including a charging member 13 attached to a base portion 10 for charging a plurality of sheets of containing bags 40, and a pivoting base portion 22 supported by the base portion 10 pivotably in a vertical face and formed with a commodity throwing opening 27 at a center portion thereof, wherein an end plate 22*a* of the pivoting base portion 22 opposed to the charging member 13 presses to hold a plurality of sheets of containing bags 40, and the apparatus is small-sized and can simply contain a commodity.

14 Claims, 16 Drawing Sheets

U.S. PATENT DOCUMENTS

| | | | | |
|---|---|---|---|---|
| 5,526,631 | A * | 6/1996 | Murakami | 53/571 |
| 5,551,219 | A | 9/1996 | Wei | 53/572 |
| 5,655,352 | A * | 8/1997 | Murakami | 53/384.1 |
| 5,765,338 | A * | 6/1998 | Tsai | 53/572 |
| 5,797,245 | A * | 8/1998 | Murakami | 53/572 |
| 5,813,196 | A * | 9/1998 | Page et al. | 53/459 |

FOREIGN PATENT DOCUMENTS

| | | |
|---|---|---|
| JP | 60-89340 | 6/1985 |
| JP | 02-146205 | 12/1990 |
| JP | 06-191508 | 7/1994 |
| JP | 6-298232 | 10/1994 |
| JP | 7-33809 | 6/1995 |
| JP | 7-205944 | 8/1995 |
| JP | 08-164927 | 6/1996 |
| JP | 11-189216 | 7/1999 |

OTHER PUBLICATIONS

Supplementary European Search Report dated Jan. 24, 2008.

* cited by examiner

ARTICLE STORAGE DEVICE

TECHNICAL FIELD

The present invention relates to a commodity containing apparatus for expanding to open a containing bag and throwing various kinds of commodities thereinto to contain, particularly relates to a commodity containing apparatus used when in order to provide seasonings of sugar and the like or milk packed by, for example, a unit of use thereof, these are throwing into a containing bag to contain or the like.

BACKGROUND ART

In a background art, there is known a bag containing apparatus of umbrella as a kind of a commodity containing apparatus. According to the bag containing apparatus of umbrella, when an umbrella is inserted into an apparatus main body from a front end thereof, the front end of the umbrella pushes to move an opening operating member facing inside of the apparatus main body downward against a spring, a claw member projected from the opening operating member is inserted into an opening of a containing bag in accordance with pivoting the opening operating member to a lower side to expand to open the containing bag, and the umbrella is inserted into the containing the bag opening of which is expanded to open from the front end to contain therein (refer to, for example, JP-A-7-205944).

DISCLOSURE OF THE INVENTION

Meanwhile, according to the bag containing apparatus of an umbrella of Patent Reference 1, mentioned above, since an object of containing is the umbrella which is long, also a total of the apparatus is large-sized. Therefore, when the bag containing apparatus of an umbrella is utilized for containing seasonings or the like packed by a unit of use thereof, mentioned above, a large space is needed and it is difficult to install the apparatus at a counter of a store.

Hence, it is an object of the invention to provide a commodity containing apparatus which is small-sized and can contain commodities simply.

In order to achieve the above-described object, a characteristic of a commodity containing apparatus of the invention resides in including a charging member attached to a base portion for charging a plurality of sheets of containing bags, and a pivoting base portion pivotably supported by the base portion in a vertical face and formed with an opening for throwing in a commodity at a center portion thereof, wherein an end plate of the pivoting base portion opposed to the charging member presses to hold the plurality of sheets of containing bags. Further, by adopting such a constitution, the plurality of sheets of containing bags are pressed to hold by the end plate of the pivoting base portion opposed to the charging member.

Further, other characteristic of the commodity containing apparatus of the invention resides in that the pivoting base portion is provided with a lever pivotably supported in a vertical face and an expanding arm inserted into an opening of a frontmost one of the containing bag charged to the charging member for expanding the containing bag when the pivoted lever recovers to an original position by a self weight thereof is supported by the lever. Further, by adopting such a constitution, the containing bag can simply be expanded by only pivoting the lever in one direction.

Further, other characteristic of the commodity containing apparatus of the invention resides in a commodity containing apparatus fixed to a fixing member of a counter or the like of a store for expanding a containing bag and throwing a commodity thereinto to contain, wherein the commodity containing apparatus includes a fixed member fixed to the fixing member, a base portion engaged attachably and detachably to and from the fixing member, a charging member attached to the base portion for charging a plurality of sheets of the contacting bags, a pivoting base portion pivotably supported by the base portion in a vertical shape, formed with an opening for throwing in the commodity at a center portion thereof, an end plate thereof opposed to the charging member pressing to hold the plurality of sheets of containing bags, and a lever pivotably supported by the pivoting base portion in a vertical face and arranged with an expanding arm inserted into an opening of a frontmost one of the containing bag charged to the charging member for expanding the containing bag when the expanding arm is pivoted and thereafter returns to an original position by a self weight thereof. Further, by adopting such a constitution, the commodity containing apparatus can easily be attached and detached by engaging the base portion to the fixed member fixed to the fixing member. Further, by pivoting the lever, the expanding arm arranged at the lever is inserted into the opening of the frontmost one of the containing bag charged to the charging member and the opening of the containing bag is expanded by returning the lever to the original position by the self weight and therefore, by throwing in the commodity from the opening for throwing the article, the commodity can easily be contained in the containing bag.

Furthermore, other characteristic of the commodity containing apparatus of the invention resides in that the fixed member is formed with a hook portion, a lock shaft extended in a longitudinal direction engaged with the hook portion of the fixed member is movably arranged at the base portion, and the lock shaft is arranged with a spring for providing an elasticity in a direction of the hook portion of the fixing member. Further, by adopting such a constitution, when the base portion is engaged with the fixing member, the lock shaft is engaged with the hook portion of the fixing member and the base portion can firmly be fixed. Further, when the base portion is detached from the fixing member, by moving the lock shaft, the lock shaft can be detached from the hook portion of the fixing member and the base portion can easily be detached.

Further, other characteristic of the commodity containing apparatus of the invention resides in that at least two sheets of end plates surrounding the opening for throwing in the commodity are inclined downward toward a center side. Further, by adopting such a constitution, when the commodity is thrown in from the opening for throwing the commodity, it can be prevented that the commodity is mounted on the end plate surrounding the opening for throwing the commodity and the commodity can smoothly be contained in the containing bag.

Further, other characteristic of the commodity containing apparatus of the invention resides in further including a holding frame fixed to the base portion and formed with a fold-to-bend portion hung downward in a vertical direction of the base portion and folded to bend in a horizontal direction such that a lowermost portion thereof is disposed downward from the plurality of sheets of containing bags, and a receiving bowl arranged at the fold-to-bend portion of the holding frame. Further, by adopting such a constitution, when the containing bag is dropped in throwing the commodity into the containing bag, the containing bag can be received by the receiving bowl to hold.

Further, according to the commodity containing apparatus of the invention, the end plate of the pivoting base portion opposed to the charging member presses to hold the plurality of containing bags and therefore, small-sized formation thereof can be achieved without needing an independent member for holding the containing bag. Further, by arranging the expanding arm to the lever, the expanding arm is inserted into the opening of the containing bag by only pivoting the lever in one direction, the opening of the containing bag is expanded by the self weight of the lever and therefore, the commodity can simply be contained.

BEST MODE FOR CARRYING OUT THE INVENTION

An embodiment of a commodity containing apparatus according to the invention will be explained in reference to the drawings as follows.

Figure 1:
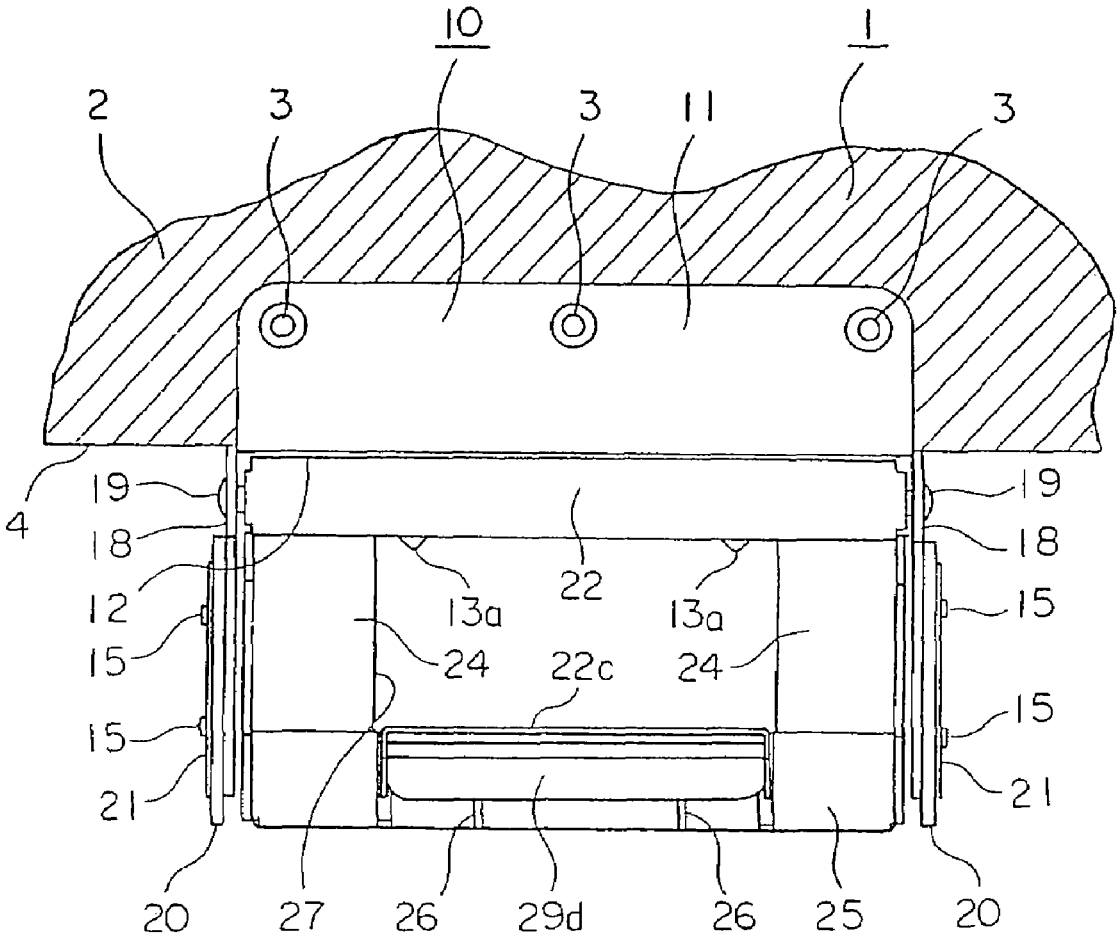
FIG. 1 is a plane view showing a first embodiment of a commodity containing apparatus according to the invention.
Figure 2:
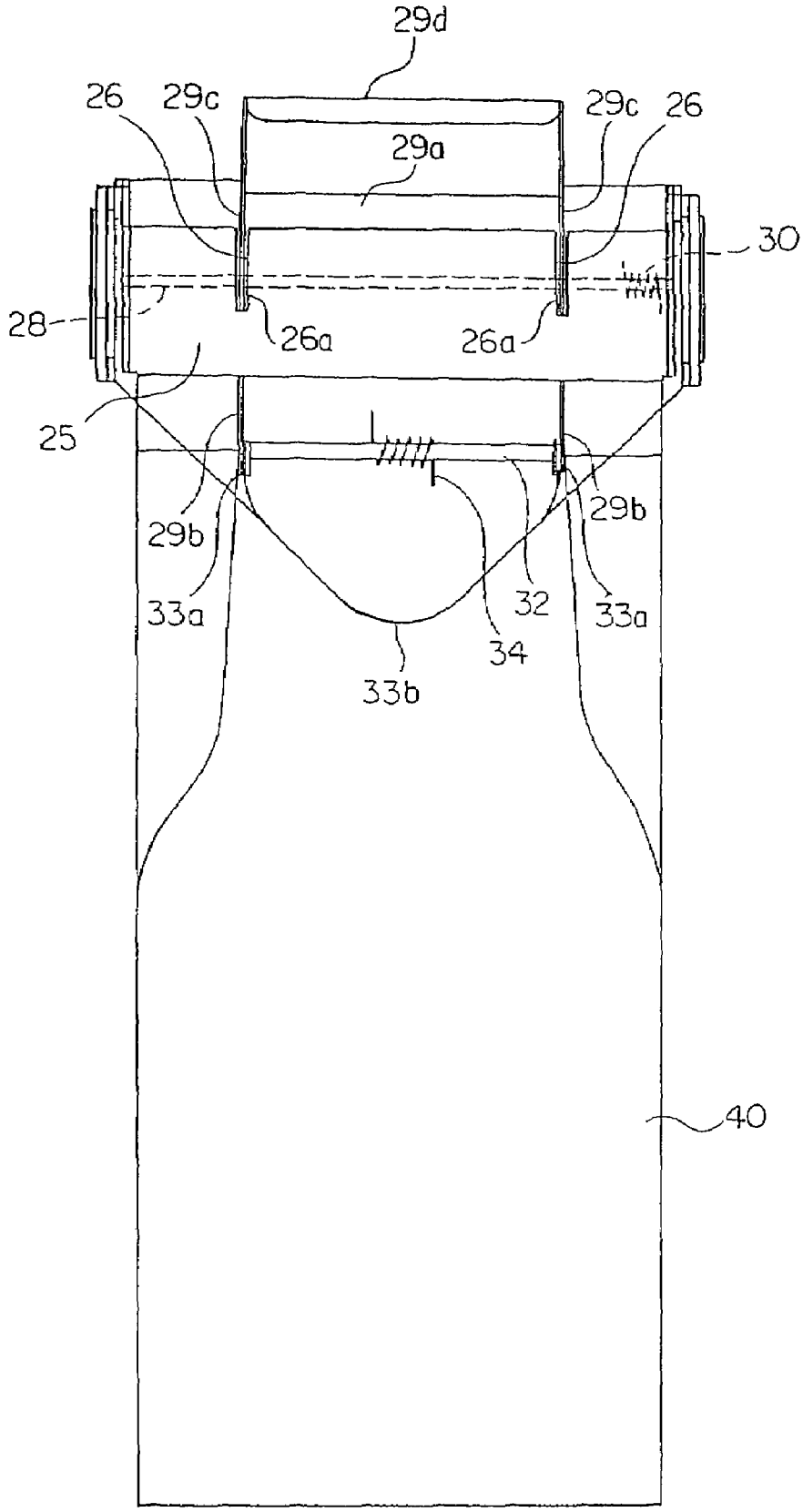
FIG. 2 is a front view of FIG. 1.
Figure 3:
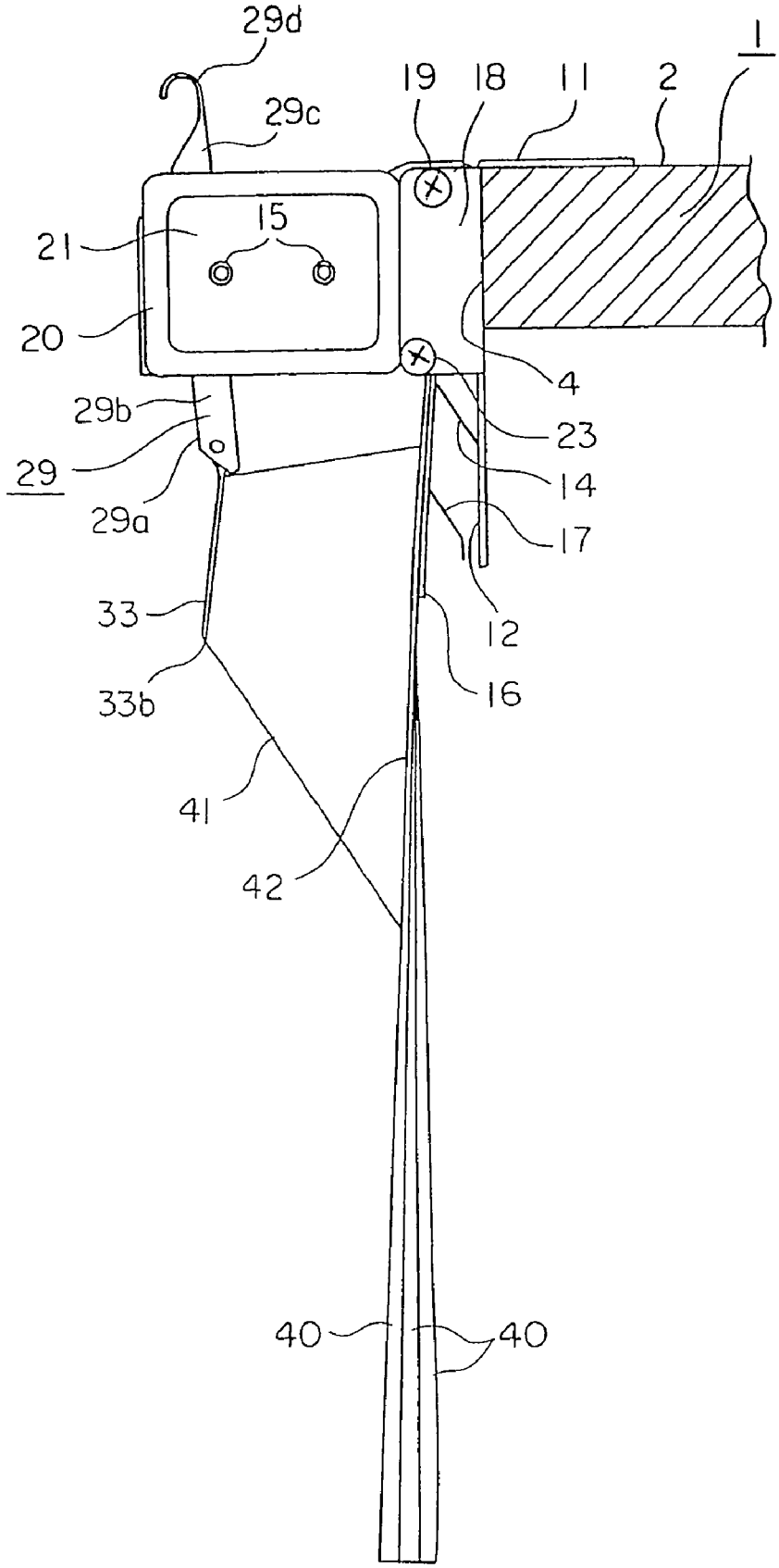
FIG. 3 is a right side view of FIG. 1.

As shown by FIG. 1 through FIG. 3, a commodity containing apparatus 9 according to the first embodiment of the invention includes a base portion 10 made of a metal fixed to a fixing member 1 such as a counter of a store. The base portion 10 is provided with a base plate 11 disposed on an upper face 2 of the fixing member 1 and fixed to the upper face 2 by a plurality of pieces of screws 3, 3 . . . , and an end edge of the base plate 11 is installed with a support plate 12 hanging down along an end face 4 of the fixing member 1 integrally with the base plate 11.

Figure 4:
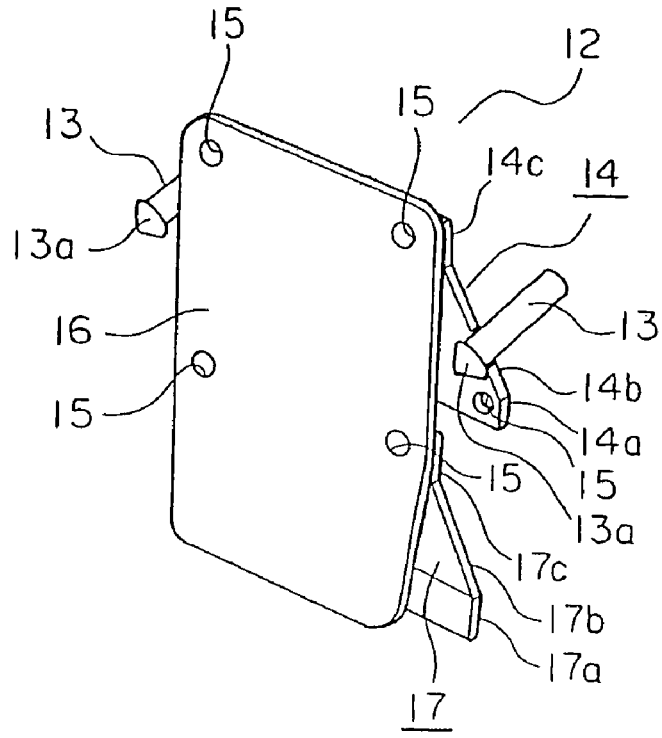
FIG. 4 is a perspective view showing a constitution of a vicinity of a support pin.

As shown by FIG. 4, the support plate 12 is projected with a pair of cylindrical support pins 13, 13 as charging members for charging a containing bag 40, mentioned later, spaced apart from each other at an interval therebetween in a left and the right direction. A front end portion of each of the support pins 13 is formed with a head portion 13*a* formed by a diameter larger than that of the support pin 13 for preventing the charged containing bag 40 from being detached. Further, at the support plate 12 between the two support pins 13, 13 and downward from the two support pins 13, 13, a lower end portion 14*a* of a leaf spring 14 made of a metal constituting substantially a rectangular shape is supported by a pair of pins 15, 15 (only one thereof is illustrated). A center portion 14*b* in an up and down direction of the leaf spring 14 is folded to bend from the lower end portion 14*a* to extend in a skewed upper direction and an upper end portion 14*c* is folded to bend from the center portion 14*b* to be in parallel with the lower end portion 14*a*.

The upper end portion 14*c* of the leaf spring 14 is fixed with an upper end portion of a contact plate 16 substantially in a rectangular shape brought into contact with the containing bag 40 at a rearmost position by a pair of pins 15, 15. Further, a center portion in an up and down direction of the contact plate 16 is fixed with an upper end portion 17*c* of a leaf spring 17 made of a metal as in a shape substantially the same as that of the leaf spring 14 by a pair of pins 15, 15, and a center portion 17*b* folded to bend from the upper end portion 17*c* of the leaf spring 17 is extended in a skewed lower direction of the contact plate 16 to be in parallel with the center portion 14*b* of the leaf spring 14. Further, a lower end portion 17*a* folded to bend from the center portion 17*b* of the leaf spring 17 faces a vicinity of the support plate 12 to be in parallel with the support plate 12.

Referring back to FIG. 1 through FIG. 3, both sides of the support plate 12 are integrally projected with left and right brackets 18, 18 projected frontward and having the same shape to constitute face symmetry to each other. Upper end portions on base end sides of the respective brackets 18 are respectively fixed with support shafts 19 coaxially in the two brackets 18, 18 and a pivoting base portion 22 made of a metal, mentioned later, are supported by the two support shafts 19 pivotably in a vertical face. Further, rubber plates 20 constituting substantially a rectangular shape are held by front end sides of the respective brackets 18 to be pinched between other holding plates 21 via pairs of pins 15, 15. Although the rubber plates 20 are for preventing a person handling the commodity containing apparatus 9 from touching other than a portion necessary for operation, the rubber plates may not be provided. Further, the respective support shafts 19 can be replaced by a single piece of a long support shaft extended between the two brackets 18.

Figure 5:
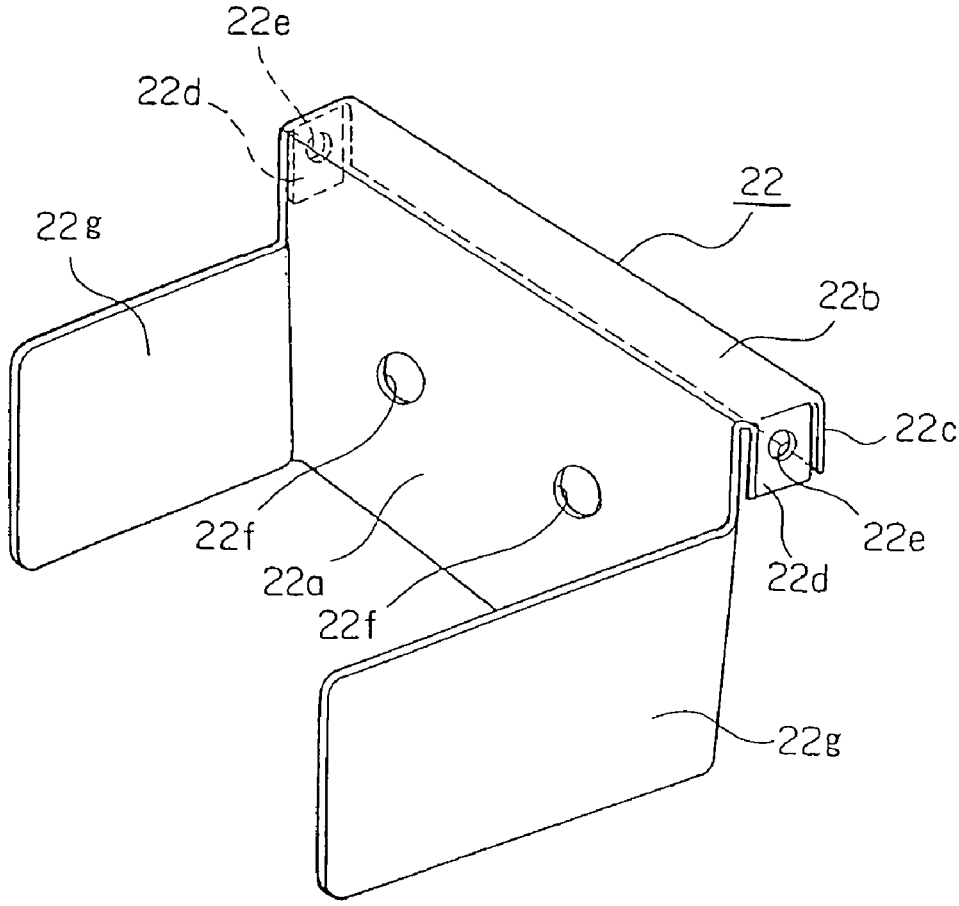
FIG. 5 is a perspective view showing a pivoting base portion of FIG. 1.

As shown by FIG. 5, the pivoting base portion 22 includes an end plate 22*a* substantially in a rectangular shape opposed to the contact plate 16. Further, a flat top plate 22*b* is projected from an upper end of the end plate 22*a* to extend in a direction of the base portion 11 and a similarly flat shield plate 22*c* is hung from a front end of the top plate 22*b* to extend downward. Further, supported plates 22*d* lower end edges of which are disposed at a height equal to that of lower end edge of the shield plate 22*c* are respectively hung from respective side edges of the top plate 22*b* and at the respective supported plates 22*d*, bearing holes 22*e* inserted with the support shafts 19 are coaxially bored at the two supported plates 22*d*, 22*d*. Therefore, the pivoting base portion 22 is pivoted in a vertical face by constituting a center of pivoting by the two support shafts 19, 19.

Portions of the end plate 22*a* opposed to the respective support pins 13 are bored with circular holes 22*f* loosely to be inserted with the head portion 13*a* of the respective support pins 13. Further, stoppers 23 in a shape of a pin brought into contact with the end plate 22*a* of the pivoting base portion 22 for stopping the end plate 22*a* of the pivoting base portion 22 substantially in a vertical state are supported by lower end portions on base end sides of the respective brackets 18.

Both sides from upper end portions to lower ends of the end plate 22*a* of the pivoting base portion 22 are integrally projected with left and right side plates 22*g*, 22*g* having the same shape projected frontward to constitute face symmetry to each other. Inner sides of upper end portions of the respective side plates 22*g* are fixed with guide plates 24 made of a metal extended in a skewed downward direction for guiding a commodity when the commodity is thrown into the containing bag 40, mentioned later, and folded to bend to direct lower end portions thereof downward in a vertical direction by pairs of pins 15, 15.

Figure 6:
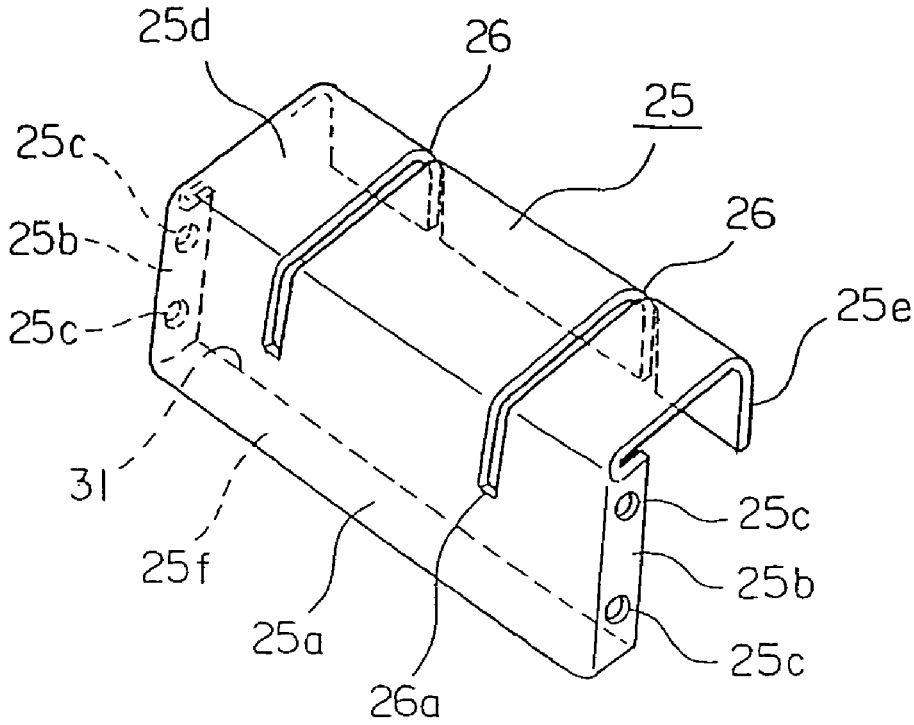
FIG. 6 is a perspective view showing a pivot restricting member of FIG. 1, FIG. 7 (*a*) is a front view of a containing bag of FIG. 1, FIG. 7 (*b*) is a right side view of the containing bag of FIG. 1.

A pivot restricting member 25 made of a metal is fixed between front end portions of the two side faces 22*g*, 22*g*. As shown by FIG. 6, the pivot restricting member 25 includes an end plate 25*a*, both side edges of the end plate 25*a* are respectively projected with supported plates 25*b* opposed to the respective side plates 22*g*, and the respective supported plates 25*b* are bored with pairs of circular holes 25*c*, 25*c* to be spaced apart from each other by an interval therebetween in an up and down direction. Further, supported plates 25*b* are fixedly attached by pairs of pins 15, 15 inserted into the circular holes 25*c*, 25*c*, thereby, the pivot restricting member 25 is bridged between the two side plates 22, 22.

Further, a top plate 25*d* is projected from an upper end of the endplate 25*a* of the pivot restricting member 25 to extend in a direction of the pivoting base portion 22, and a flat shield plate 25*e* extended downward is hung from a front end of the top plate 25*d*. Further, the pivot restricting member 25 is formed with two pieces of slits 26 having the same shape to be spaced apart from each other by an interval therebetween in a left and right direction. Each of the slits 26 is extended upward from a center position in an up and down direction and communicates with outside at a lower end edge of the shield plate 25*e* by vertically cutting the top plate 25*d* and the shield plate 25*e* respectively. Further, a lower end edge of the end plate 25*a* is integrally installed with a flat bottom plate 25*f* disposed between the two supported plates 25*b*, 25*b*.

An opening 27 (FIG. 1) for dropping a commodity is formed on inner sides of the end plate 22*a* of the pivoting base portion 22, by guide plates 24 fixed to the respective guide plates 22*g*, and the shield plate 25*e* of the pivot restricting member 25.

A long support shaft 28 is pivotably supported between the two side plates 22*g*, 22*g* of the pivoting base portion 22 at a portion constituting an inner side of the pivot restricting member 25 and a lever 29 is rotatably supported by the support shaft 28. As shown by FIG. 2, the lever 29 includes a lever main body 29*a* constituting substantially a rectangular shape. Both sides of the lever main body 29*a* are integrally installed with the supported plates 29*b*, 29*b* to be respectively folded to bend from the lever main body 29*a* in right angle, the supported plates 29*b*, 29*b* are bored with circular holes (not illustrated) in a coaxial state. Further, the lever 29 is pivotably supported by inserting the support shaft 28 through the two circular holes.

An upper end edge of the lever main body 29*a* of the lever 29 is integrally installed with a pair of arms 29*c*, 29*c* constituting extensions of the respective supported plates 29*b*, 29*b* and extended upward, and a handle 29*d* constituted by folding to bend an upper end portion thereof is integrally bridged between the two arms 29*c*, 29*c*. Further, when the lever 29 is pivoted, the two arms 29*c*, 29*c* are moved in the two slits 26 without being brought into contact with inner side edges of the slits 26.

The support shaft 28 is wound with a coil spring 30 for urging the lever 29 in the clockwise direction in FIG. 3. On the other hand, the bottom plate 25*f* of the pivot restricting member 25 is projected with a stopper 31 at a portion constituting an extension of the slit 26 on one side and when the lever is brought into substantially an erected state by the coil spring 30, the lever 29 is brought into contact with the support plate 29*b* on one side to restrain the lever 29 from being pivoted further.

When the lever 29 is brought into above-described erected state of FIG. 3, an upper end of the lever main body 29*a* is disposed at a position proximate to the top plate 25*d* of the pivot restricting member 25. Further, when the lever 29 is pivoted in the counterclockwise direction against the coil spring 30 by the handle 29*d* and the respective arms 29*c* are brought into contact with end edges 26*a* of the end plate 25*a* of the respective slits 26, a lower end portion of the lever main body 29*a* faces the head portion 13*a* of the support pin 13.

Lower end portions of the two supported plates 29*b*, 29*b* are bored with circular holes (not illustrated) in a coaxial state. Further, a support shaft 32 is inserted through and supported by the two circular holes. The support shaft 32 is inserted into brackets 33*a*, 33*a* and respectively formed at two upper corner portions of an expanding arm 33 formed in a shape of substantially an inverse triangle extended downward from the lever main body 29*a*, and the expanding arm 33 is pivotably supported by the support shaft 32 to be able to be pivoted in the clockwise direction from a position shown in FIG. 3. The support shaft 32 is wound with a coil spring 34 for urging the expanding arm 33 in the counterclockwise direction in FIG. 3.

Figure 7:
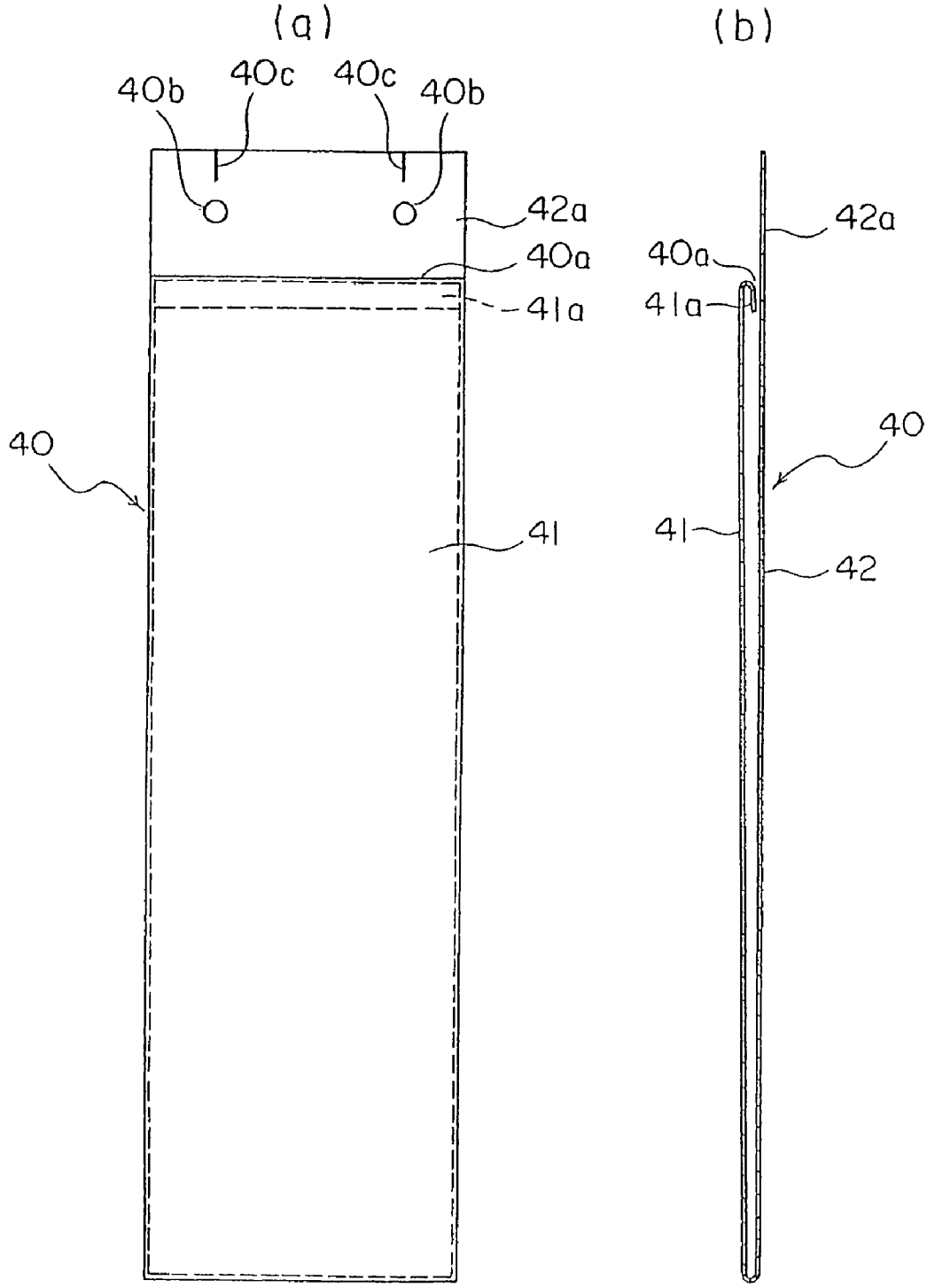

As shown by FIG. 7, according to the first embodiment, the containing bag 40 is formed in a shape of an envelope to include an inserting port 40*a* at an upper portion thereof by a synthetic resin film or the like, and an upper end portion 41*a* of a front piece 41 at the inserting port 40*a* is folded back in a U-like shape. Although in FIG. 7, the upper end portion 41*a* is folded back to a rear side, that is, a side of a rear piece 42, the upper end portion 41*a* may be folded back in a front side, that is, a side opposed to the rear piece 42. Further, an upper end portion 42*a* of the rear piece 42 is projected more upward than the upper end portion 41*a* of the front piece 41 and the projected upper end portion 42*a* is formed with a pair of attaching holes 40*b*, 40*b* to be inserted with the two support pins 13, 13 to be spaced apart from each other by an interval therebetween in a left and right direction. Further, upper end portions of the rear piece 42 right above the respective attaching holes 40*b* are formed with cut lines 40*c* for easily cutting upper sides of the attaching holes 40*b* by pulling the containing bag 40 downward so as not to reach the respective attaching holes 40*b*.

Figure 8:
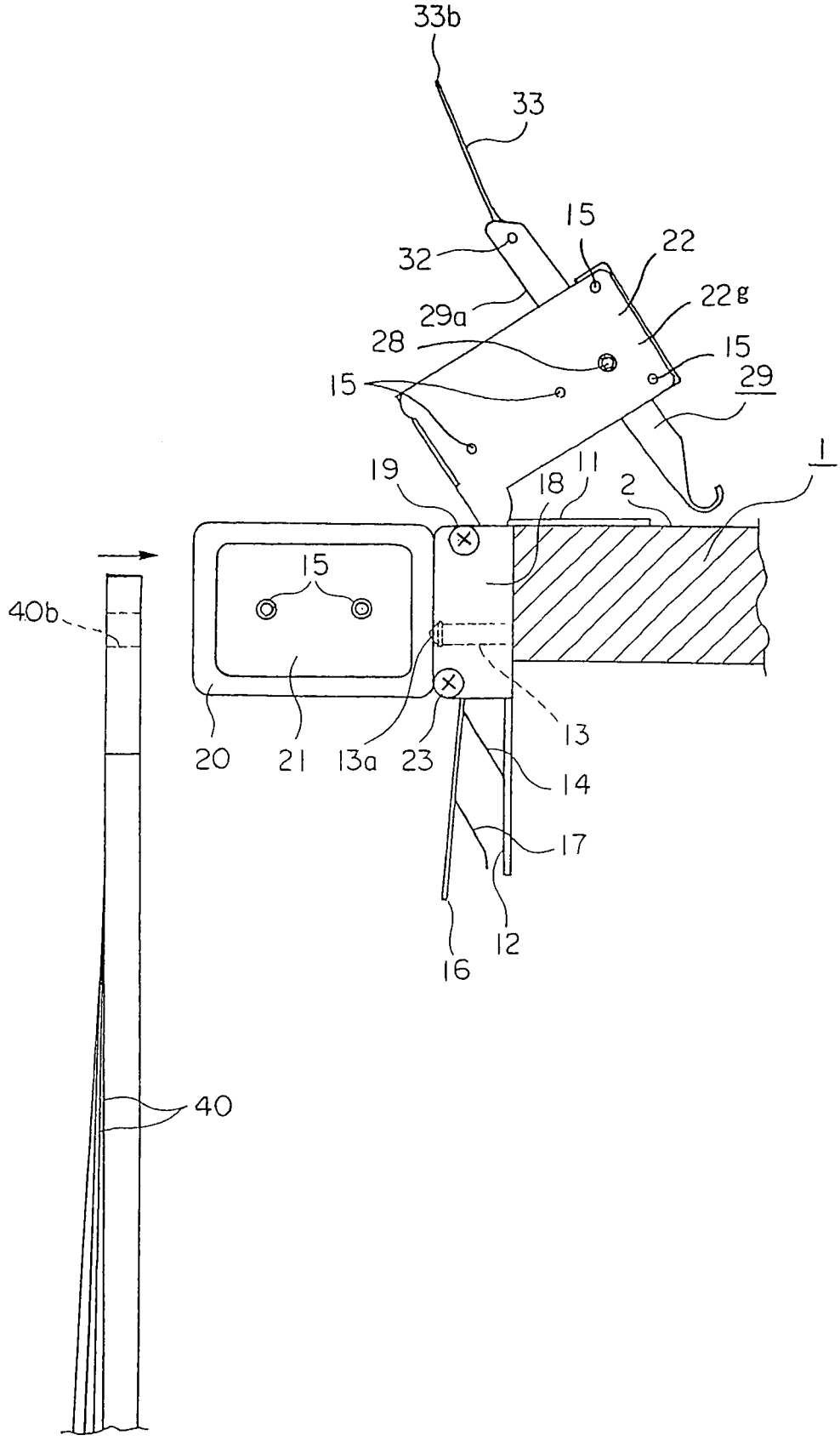
FIG. 8 is a right side view showing a state of mounting the containing bag in the embodiment of FIG. 1.

Next, operation of the embodiment constituted by the above-described constitution will be explained. First, as shown by FIG. 8, the pivoting base portion 22 is pivoted from a regular state in the clockwise direction along with the pivot restricting member 25, the lever 29, the expanding arm 33 and the like and a number of the containing bags 40, 40 are mounted to the two support pins 13, 13 by locking the attaching holes 40*b*, 40*b* of the respective containing bags 40. At this occasion, the contact plate 16 urged frontward by the leaf springs 14, 17 is disposed at a rear portion of the containing bag 40. Thereafter, the pivoting base portion 22 is pivoted in the counterclockwise direction along with the pivot restricting member 25, lever 29, the expanding arm 33 and the like. Then, the end plate 22*a* of the pivoting base portion 22 pinches a number of the containing bags 40 between the end plate 22*a* and the contact plate 16 urged frontward by the leaf springs 14, 17 between the two support pins 13, 13.

Under the state, when the lever 29 disposed at the position shown in FIG. 3 is pivoted in the counterclockwise direction, the respective arms 29*d* of the lever 29 are brought into contact with the end edges 26*a* of the respective slits 26 and the lever 29 is stopped substantially in a horizontal direction. At this occasion, the expanding arm 33 is pivoted in the clockwise direction against the coil spring 34 by being brought into contact with the end plate 22*a* of the pivoting base portion 22 and is directed in a vertical direction to be along the end plate 22*a* such that a front end 33*b* thereof is disposed on an upper side of the inserting port 40*a* of the containing bag 40 disposed at a frontmost end.

Hence, when the hand is left from the handle 29*d* of the lever 29, the lever 29 is pivoted in the clockwise direction by its own weight and returns to the position shown in FIG. 3. At this occasion, the expanding arm 33 always maintains vertical state by operation of the coil spring 34 although the lever main body 29*a* of the lever 29 is brought into an inclined state and the front end 33*b* is directed downward to move down and therefore, the expanding arm 33 is gradually inserted into the inserting port 40*a* of the containing bag 40 at which the front end 33*b* of the expanding arm 33 is disposed. Therefore, when the state of FIG. 3 is recovered, the expanding arm 33 can expand the inserting port 40*a* to separate the front piece 41 and the rear piece 42 of the containing bag 40.

Hence, when the commodity is thrown in from the opening, the commodity is firmly thrown into the containing bag 40. Thereafter, when the containing bag 40 contained with the commodity is pulled downward, the respective cut lines 40*c* of the containing bag 40 reach the respective attaching holes 40*b* and the containing bag 40 can be taken out. In order to expand a successive one of the containing bag 40, after pivoting the lever 29 in the counterclockwise direction again, the hand may be left therefrom.

As explained above, according to the embodiment, when the pivoting base portion 22 is pivoted upward and the containing bag 40 is mounted and the pivoting base portion 22 is recovered to an original state, the containing bag 40 can stably be held by the end plate 22*a* of the pivoting base portion 22. Further, by only pivoting the lever in the counterclockwise direction, the inserting port 40*a* of the containing bag 40 can simply be expanded. Therefore, the containing bag 40 can be held or expanded by a small-sized and simple constitution.

Next, a second embodiment of a commodity containing apparatus according to the invention will be explained. Further, constitutions of the second embodiment the same as or corresponding to those of the first embodiment are shown by attaching the same notations.

Figure 9:
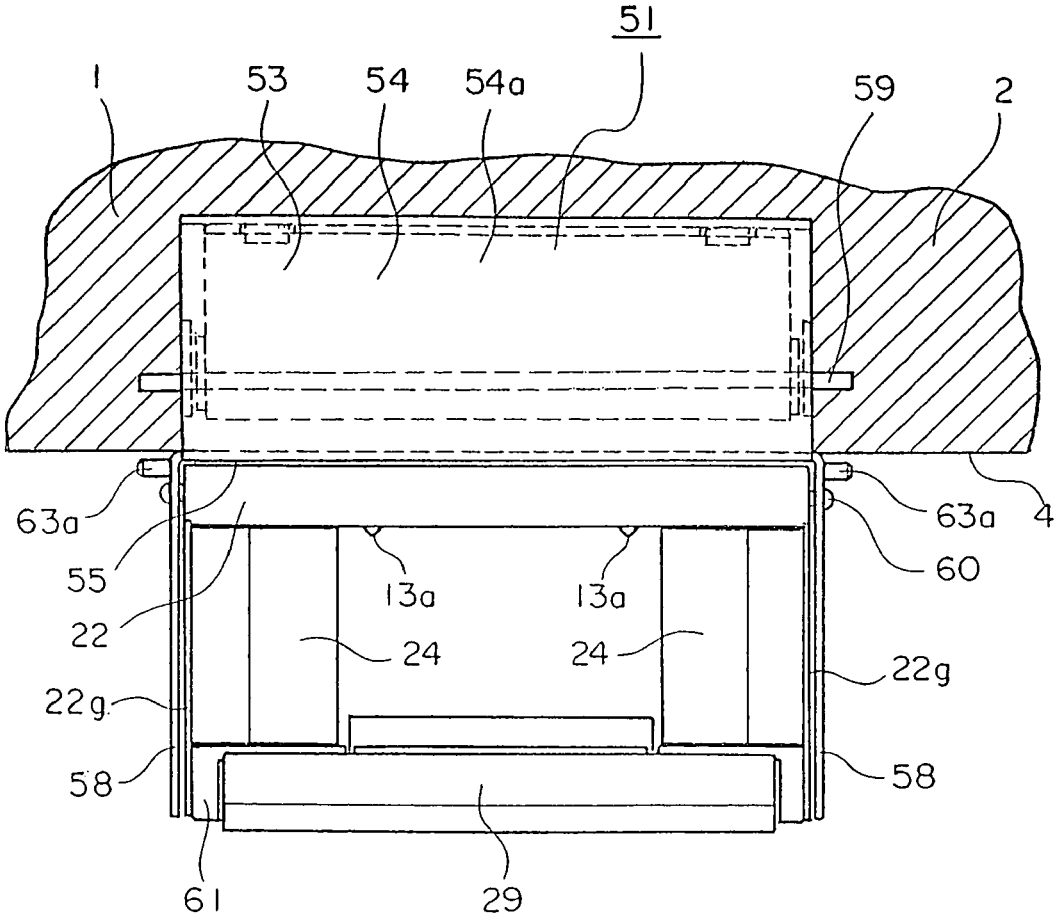
FIG. 9 is a plane view showing a second embodiment of a commodity containing apparatus according to the invention.
Figure 10:
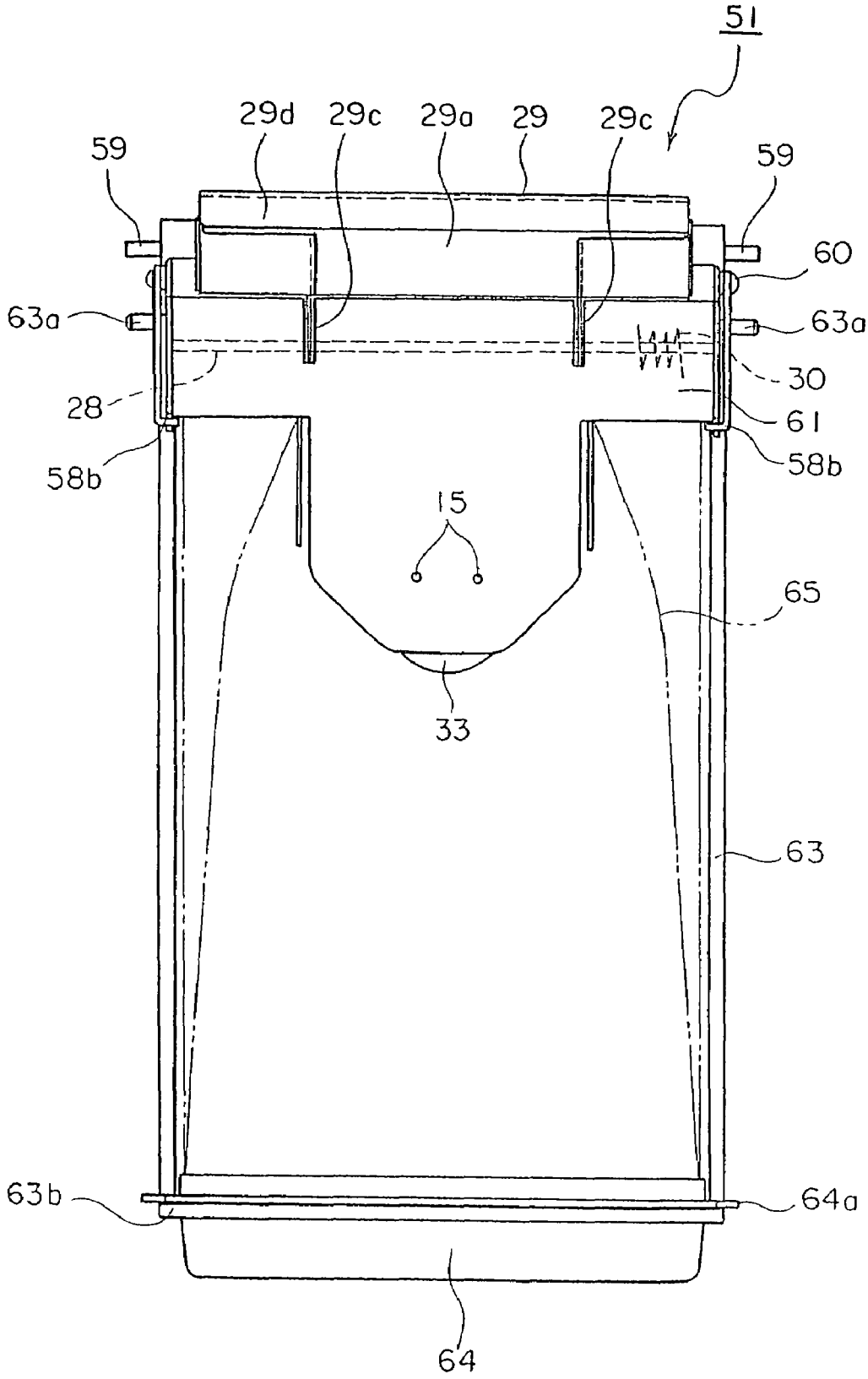
FIG. 10 is a front view of FIG. 9.
Figure 11:
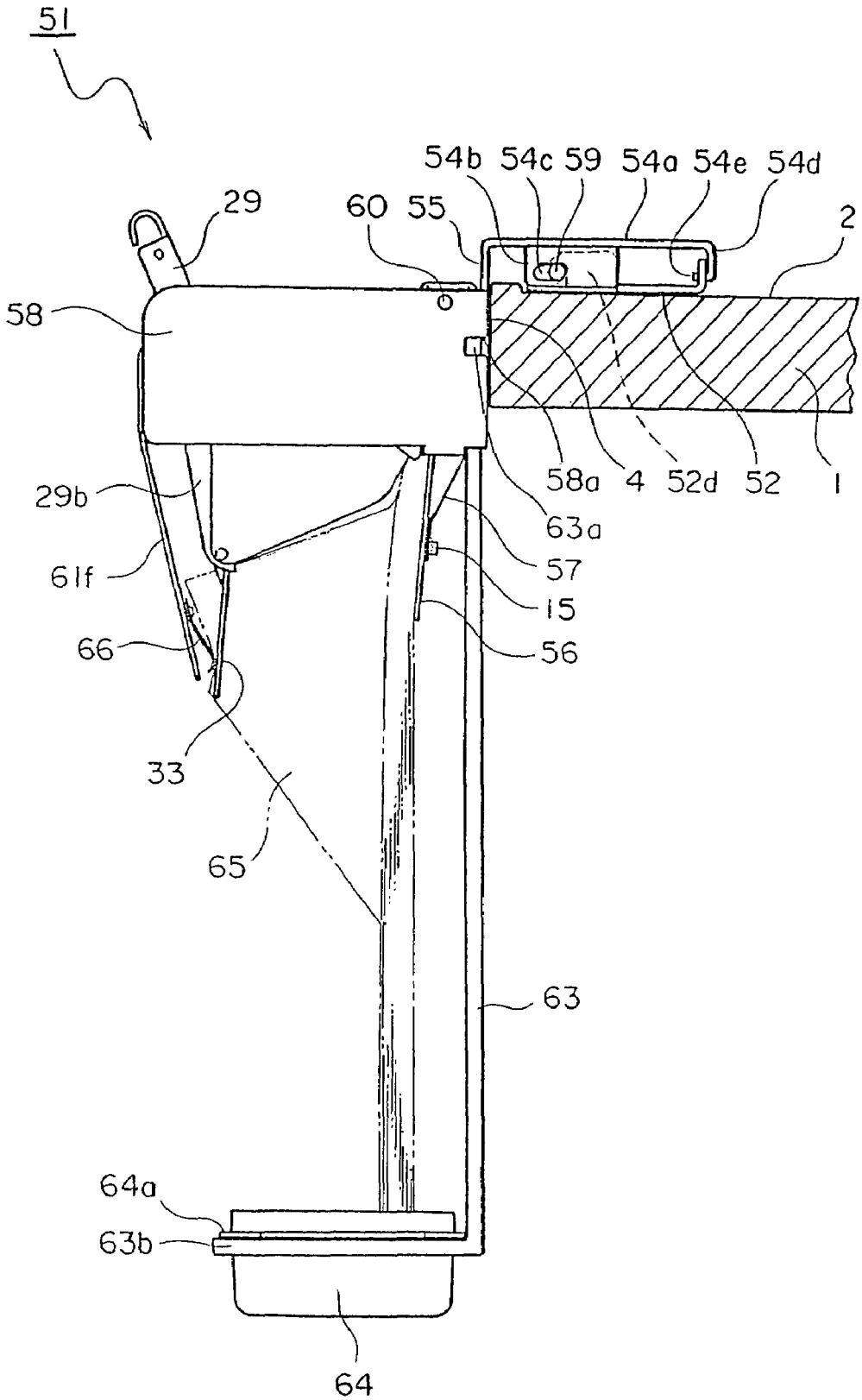
FIG. 11 is a right side view of FIG. 9.

As shown by FIG. 9 through FIG. 11, a commodity containing apparatus 51 of the second embodiment includes a fixed member 52 made of a metal fixed to the upper face 2 of the fixing member 1 of a counter of a store or the like and a base portion 53 made of a metal engaged and fixed to the fixed member 52.

Figure 12:
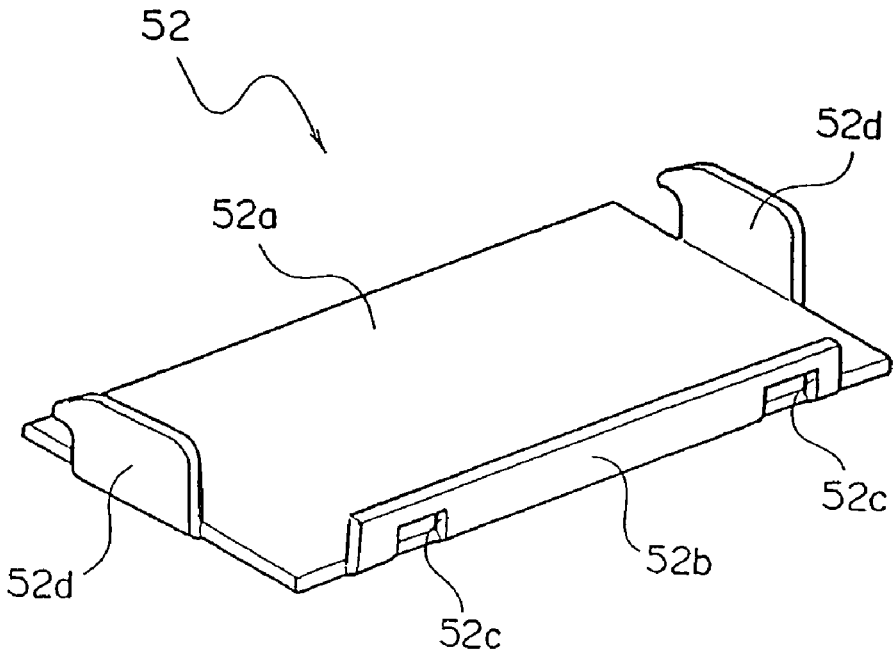
FIG. 12 is a perspective view showing a fixing member of FIG. 9.

As shown by FIG. 12, the fixed member 52 is constituted by a fixed face 52*a* substantially in a rectangular shape fixed to the fixing member 1, a fold-to-bend face 52*b* folded to bend upward from one long side of the fixed face 52*a* and bored with two openings 52*c* according to the embodiment, and hook portions 52*d*, 52*d* folded to bend upward from respective short sides of the fixed face 52*a* and engaged with a lock shaft 59, mentioned later. Further, the fixed member 52 is arranged at the upper face of the fixing member 1 and fixed to the upper face by a both faces tape or a plurality of screws (both of which are not illustrated) or the like.

Figure 13:
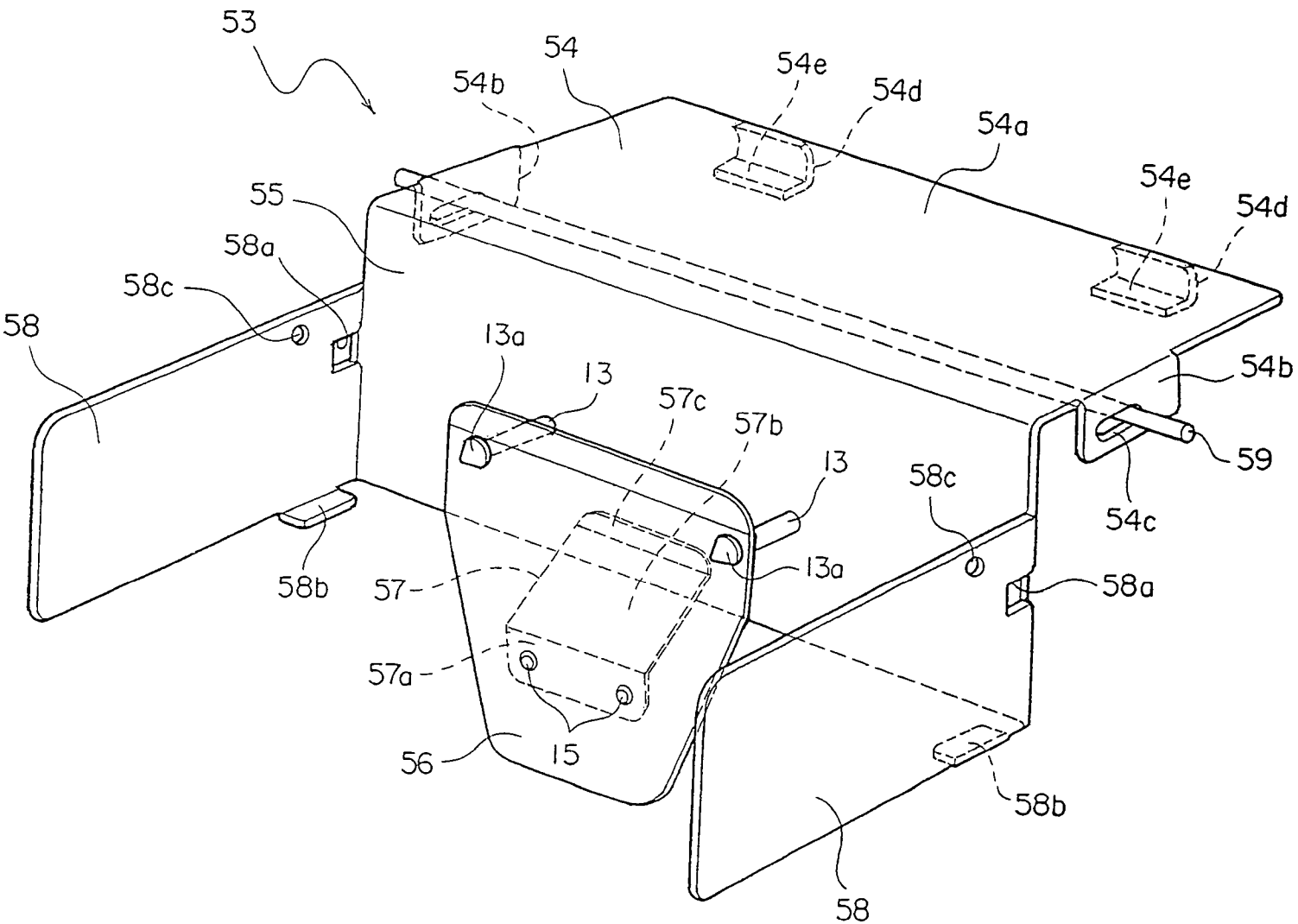
FIG. 13 is a perspective view showing a base portion of FIG. 9.

As shown by FIG. 13, the base portion 53 is provided with an engaging portion 54 to be engaged with the fixed member 52 and an end edge of the engaging portion 54 is installed with a support plate 55 hung along the end face 4 of the fixing member 1 integrally with the engaging portion 54.

The engaging portion 54 is constituted by a top plate 54*a* formed substantially in a rectangular shape, side plates 54*b*, 54*b* folded to bend downward from respective short sides of the top plate 54*a* and respectively bored with openings 54*c* to which the lock shaft 59 is inserted, and end plates 54*d* contiguous to the side plates 54*b*, 54*b*, folded to bend downward to be opposed to the support plate 55 and formed with projections 54*e*, 54*e* engaged with the respective openings 52*c* of the fixed member 52 on an inner face side thereof. Further, the lock shaft 59 is extended to be inserted into the openings 54*c*, 54*c* of the respective side plates 54*b*, 54*b* to project therefrom respectively and is urged elastically to a side of the end plate 54*d* by a spring (not illustrated).

As shown by FIG. 11 and FIG. 13, the support plate 55 is projected with the pair of cylindrical support pins 13, 13 as charging members for charging a containing bag 65 to be spaced apart from each other by an interval in a left and right direction. The two support pins 13, 13 are inserted with an upper portion in an up and down direction of a contact plate 56 substantially in a rectangular shape brought into contact with the containing bag 65 at a rearmost position and formed with the head portions 13*a* diameters of which are formed to be larger than those of the support pins 13 in order to prevent the containing bag 65 and the contact plate 56 from being detached. Further, at substantially a center portion of the contact plate 56, a lower end portion 57*a* of a leaf spring 57 made of a metal constituting substantially a rectangular shape is fixed by a pair of pins 15, 15, a center portion 57*b* in an up and down direction of the leaf spring 57 is folded to bend on the lower end portion 57*a* to extend in a skewed upper direction and an upper end portion 57*c* of the leaf spring 57 is folded to bend from the center portion 57*b* to be in parallel with the lower end portion 57*a*.

Further, both sides of the support plate 55 are integrally projected with left and right brackets 58, 58 having the same shape projected forward to constitute face symmetry with each other. A support shaft 60 is fixed to bearings 58*c* coaxially formed at upper end portions of base end sides of the respective brackets 58 and the pivoting base portion 22 made of the metal, mentioned later, is pivotably supported by the support shaft 60 in a vertical face. Further, substantially center portions on base end sides of the respective brackets 58, 58 are respectively formed with openings 58*a*, 58*a* to be engaged with end portions 63*a*, 63*a* of a holding frame 63 for holding a receiving bowl 64, mentioned later. Further, lower end portions of base end sides of the respective brackets 58 are integrally formed with restricting plates 58*b* projected to inner sides respectively brought into contact with projected portions 22*h* of respective side plates 22*g* of the pivoting base portion 22, mentioned later, for restricting the pivoting base portion 22 from pivoting downward.

The holding frame 63 is formed substantially in a U-like shape from a metal material, the respective end portions 63*a*, 63*a* are folded to bend respectively to outer sides to be engaged with the openings 58*a*, 58*a* of the respective brackets 58, 58, and a lower side of the holding frame 63 is formed with a mounting portion 63*b* folded to bend frontward to be able to mount the receiving bowl 64. Further, according to the embodiment, the receiving bowl 64 is formed by a resin material and a peripheral edge portion of the receiving bowl 64 is formed with a flange 64*a* mounted on the mounting portion 63*b* of the holding frame 63. The receiving bowl 64 is constituted to receive the containing bag 65 to prevent the containing bag 65 from being dropped when a commodity is thrown into the containing bag 65 from the opening 27, mentioned later, and the containing bag 65 is cut to separate to be dropped by a weight of the commodity.

Figure 14:
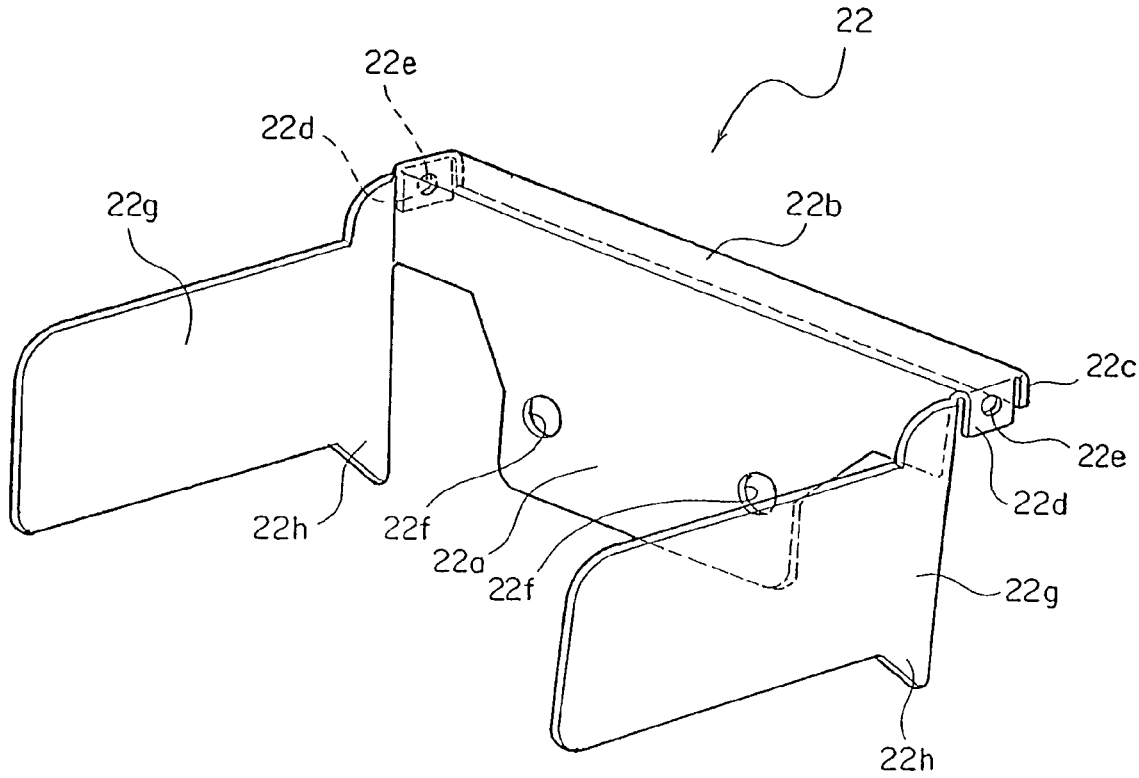
FIG. 14 is a perspective view showing a pivoting base portion of FIG. 9.

As shown by FIG. 14, the pivoting base portion 22 includes the end plate 22*a* substantially in the rectangular shape opposed to the contact plate 56. Further, the flat top plate 22*b* is projected from the upper end of the end plate 22*a* to extend in a direction of the base portion 53, and the similarly flat shield plate 22*c* extended downward is hung from the front end of the top plate 22*b*. Further, the supported plates 22*d* the lower end edges of which are disposed at the height equal to that of the lower end edges of the shield plates 22*c* are respectively hung from the respective side edges of the top plate 22*b* and the respective supported plates 22*d* are bored with the bearing holes 22*e* inserted with the respective end portions of the support shaft 60 coaxially in the two supported plates 22*d*, 22*d*. Therefore, the pivoting base portion 22 is pivoted in the vertical face by constituting the pivoting center by the support shaft 60.

The portions of the end plate 22*a* opposed to the respective support pins 13 are bored with circular holes 22*f* loosely inserted with the head portions 13*a* of the respective support pins 13. Further, the both sides from the upper end portion to the lower end of the end plate 22*a* of the pivoting base portion 22 are integrally projected with the left and right side plates 22*g*, 22*g* having the same shape projected frontward to constitute face symmetry to each other, and lower end portions of base end sides of the respective side plates 22*g*, 22*g* are respectively integrally formed with the projected portions 22*h* projected downward brought into contact with the restricting plates 58*b* formed at the respective brackets 58, 58 of the support plate 55. Further, as shown by FIG. 9, the inner sides of the upper end portions of the respective side plates 22*g* are fixed with the guide plates 24 made of a metal extended in a skewed downward direction for guiding a commodity when the commodity is thrown into the containing bag 65, mentioned later, and directing the lower end portions downward in the vertical direction by pair of pins 15, 15.

Figure 15:
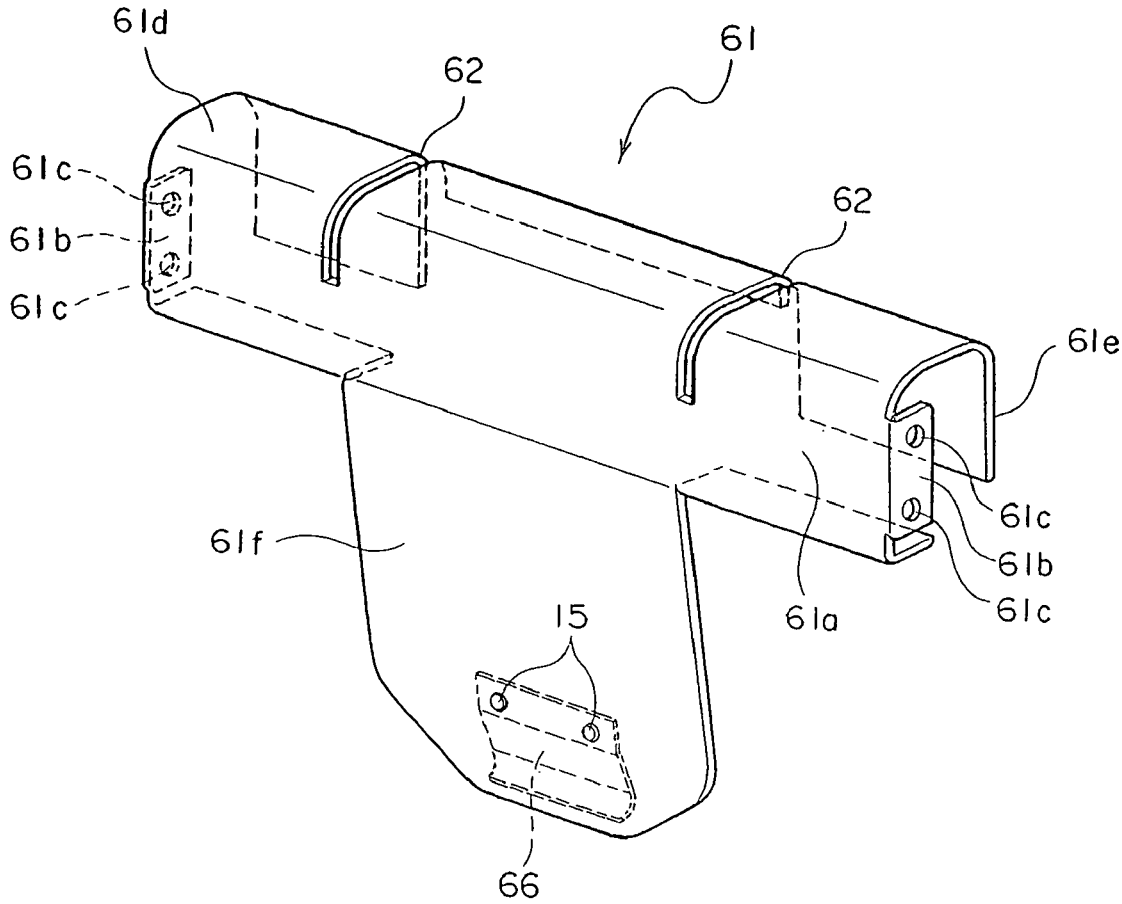
FIG. 15 is a perspective view showing a pivot restricting member of FIG. 9, FIG. 16 (*a*) is a front view of a containing bag of FIG. 9, FIG. 16 (*b*) is a right side view of the containing bag of FIG. 9.

A pivot restricting member 61 made of a metal is fixed between front end portions of the two side plates 22*g*, 22*g*. As shown by FIG. 15, the pivot restricting member 61 includes an end plate 61*a*, both side edges of the end plate 61*a* are respectively projected with supported plates 61*b* opposed to the respective side plates 22*g*, and the respective supported plates 61*b* are bored with pairs of circular holes 61*c*, 61*c* to be spaced apart from each other in an up and down direction. Further, the supported plates 61*b* are fixedly attached by pairs of pins 15, 15 inserted to the circular holes 61*c*, 61*c*, thereby, the pivot restricting member 61 is bridged between the two side plates 22, 22.

Further, a top plate 61*d* is projected from an upper end of the end plate 61*a* of the pivot restricting member 61 to extend in a direction of the pivoting base portion 22 and a flat shield plate 61*e* extended downward and hung from a front end of the top plate 61*d*. Further, the pivot restricting member 61 is formed with two pieces of slits 62 having the same shape to be spaced apart from each other in a left and right direction. Each of the slits 62 is extended upward from a center position in an up and down direction of the end plate 61*a* and is communicated with outside at a lower end edge of the shield plate 61*e* by respectively vertically cutting the top plate 61*d* and the shield plate 61*e*. Furthermore, a lower end edge of the end plate 61*a* is integrally connected with an extended plate 61*f* formed to be extended downward by being inclined in a direction of the end plate 22*a* of the pivoting base portion 22 and as shown by FIG. 11, an inner side face of the extended plate 61*f* is fixed with a leaf spring 66 brought into contact with the expanding arm 33, mentioned later, by a pair of pins 15.

The opening 27 (FIG. 9) for dropping a commodity is formed on inner sides of the end plate 22*a* of the pivoting base portion 22, by guide plate 24 fixed to the respective side plates 22*g*, and the shield plate 61*e* of the pivot restricting member 61. The long support shaft 28 is rotatably supported between the two side plates 22*g*, 22*g* of the pivoting base portion 22 at the portion constituting the inner side of the pivot restricting member 61 and the lever 29 is rotatably supported by the support shaft 28. As shown by FIG. 10, the lever 29 includes the lever main body 29*a* constituted substantially in the rectangular shape. As shown by FIG. 11, the both sides of the lever main body 29*a* are integrally provided with the flat support plates 29*b*, 29*b* to be respectively folded to bend from the lever main body 29*a* in right angle and the two support plates 29*b*, 29*b* are bored with the circular holes (not illustrated) in the coaxial state. Further, by inserting the support shaft 28 through the two circular holes, the lever 29 is pivotably supported.

The upper end edge of the lever main body 29*a* of the lever 29 is integrally provided with the pair of arms 29*c*, 29*c* extended upward constituting extensions of the respective support plates 29*b*, 29*b*, and the handle 29*d* constituted by bending to form the upper end portion is integrally bridged between the two arms 29*c*, 29*c*. Further, when the lever 29 is pivoted, the two arms 29*c*, 29*c* are moved in the two slits 62 without being brought into contact with the inner side edges of the slits 62.

The support shaft 28 is wound with the coil spring 30 for urging the lever 29 in the clockwise direction in FIG. 11, when the lever 29 is brought into substantially the erected state by the coil spring 30, the expanding arm 33 is brought into contact with the leaf spring 66 fixed to extended plate 61*f* of the pivot restricting member 61 to restrain further pivoting of the lever 29.

When the lever 29 is brought into the above-described erected state of FIG. 11, the upper end of the lever main body 29*a* is disposed at the position proximate to the top plate 61*d* of the pivot restricting member 61. Further, when the lever 29 is pivoted in the counterclockwise direction against the coil spring 30 by the handle 29*d* and the respective arms 29*c* are brought into contact with the end edges 26*a* of the end plate 61*a* of the respective slits 62, the lower end portion of the lever main body 29*a* faces the vicinity of the head portion 13*a* of the support pin 13.

The lower end portions of the two support plates 29*b*, 29*b* are bored with the circular holes (not illustrated) in the coaxial state. Further, the support shaft 32 is inserted through and supported by the two circular holes. The support shaft 32 is inserted through the brackets 33*a*, 33*a* respectively formed at the two upper corner portions of the expanding arm 33 formed in the flat plate shape substantially in the inverse triangle shape, and extended downwardly from the lever main body 29*a*, and the expanding arm 33 is pivotably supported to be able to be pivoted in the clockwise direction from the position shown in FIG. 17. The support shaft 32 is wound with the coil spring 34 for urging the expanding arm 33 in the counterclockwise direction in FIG. 11.

Figure 16:
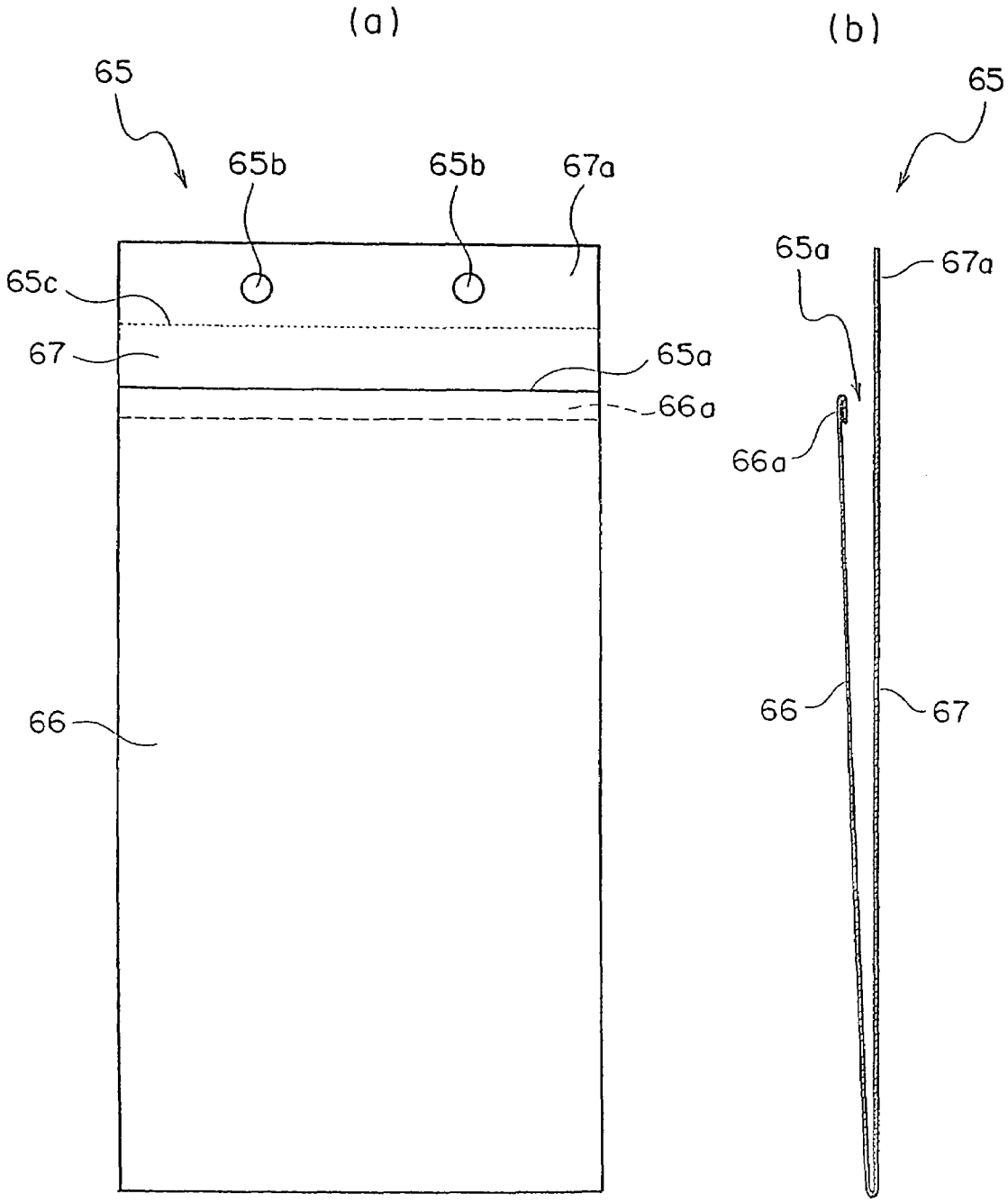

According to the second embodiment, as shown by FIG. 16, the containing bag 65 is formed in a shape of an envelope to include an inserting port 65*a* at an upper portion thereof by a synthetic resin film or the like and an upper end portion 66*a* of a front piece 66 at the inserting port 65*a* is folded back in a U-like shape. Although in FIG. 16, the upper end portion

66*a* is folded back to a rear side, that is, to a side of a rear piece 67, the upper end portion 66*a* may be folded back to a front side, that is, to a side opposed to the rear piece 67. Further, an upper end portion 67*a* of the rear piece 67 is projected more upwardly than an upper end portion 66*a* of the rear piece 66 and the projected upper end portion 67*a* is formed with a pair of attaching holes 65*b*, 65*b* to be inserted with the two support pins 13, 13 to be spaced apart from each other in a left and right direction. Further, lower sides of the respective attaching holes 65*b* are formed with a cut line 65*c* for easily cutting the containing bag 65 by pulling downward the containing bag 65 in a horizontal direction as illustrated.

Next, operation of the second embodiment constituted by the above-described constitution will be explained. First, as shown by FIG. 3, the fixed member 52 is fixed to the upper face 2 of the fixing member 1 by a screw, a both faces tape (both of which are not illustrated) or the like. Further, respective openings 52*a* of the fixed member 52 are engaged with the respective projections 54*e*, 54*e* formed at the engaging portion 54, and the base portion 53 is fixed to the fixed member 52. At this occasion, the lock shaft 59 is engaged with the respective lock portions 52*d*, 52*d* of the fixed member 52 by an elasticity of a spring (not illustrated) to lock the base portion 53 to be prevented from being detached from the fixed member 52 by being pivoted upward in FIG. 3.

Figure 17:
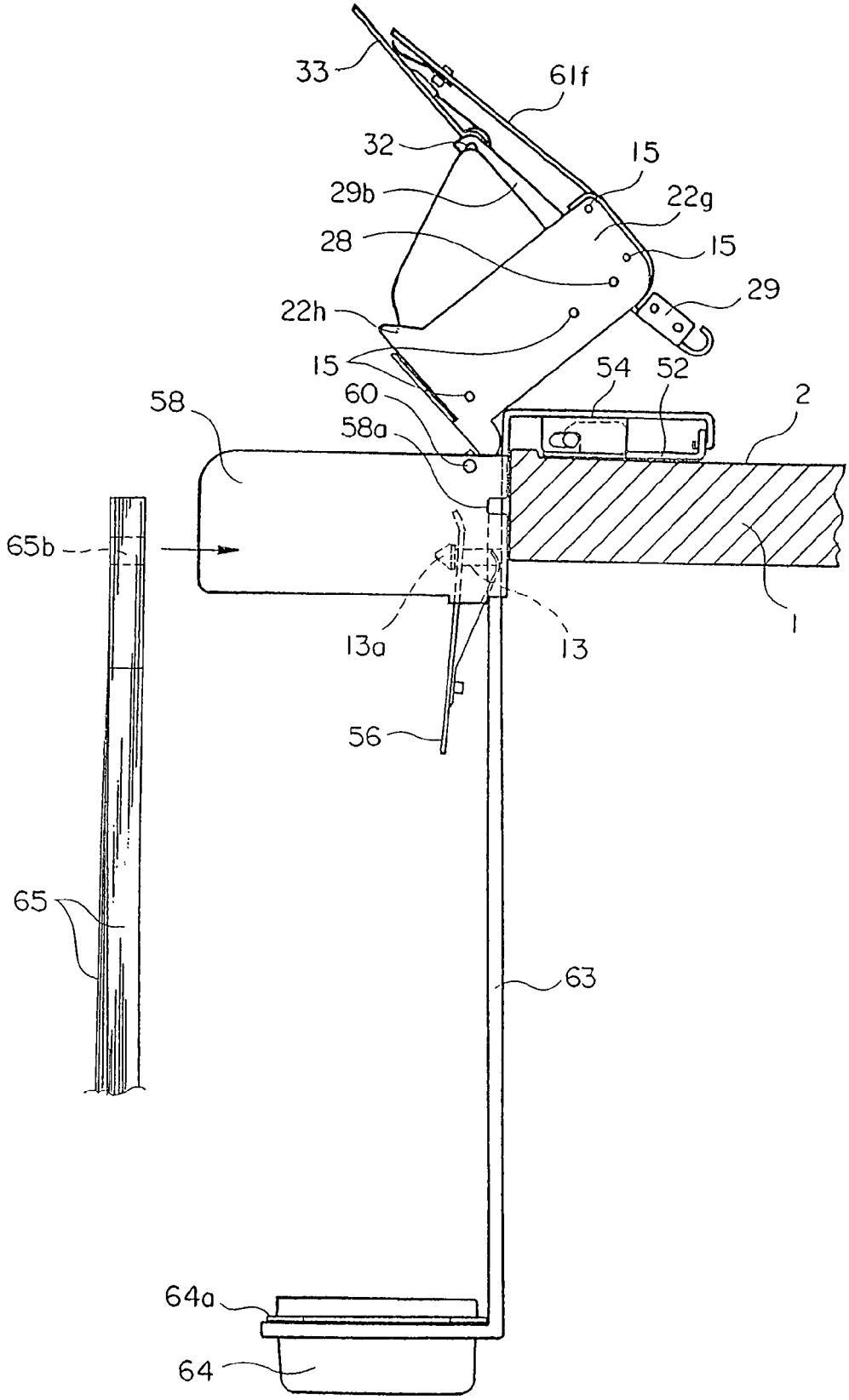
FIG. 17 is a right side view showing a state of mounting the containing bag in the embodiment of FIG. 9.

Next, as shown by FIG. 17, the pivoting base portion 22 is pivoted in the clockwise direction from a regular state along with the pivot restricting member 61, the lever 29, the expanding arm 33 and the like and a number of the containing bags 65, 65 are mounted to the two support pins 13, 13 by being locked by the attaching holes 65*b*, 65*b* of respective containing bags 65. At this occasion, at a rear portion of the containing bag 65, the contact plate 56 urged forward by the leaf spring 57 is disposed. Thereafter, the pivoting base portion 22 is pivoted in the counterclockwise direction along with the pivot restricting member 61, the lever 29 and the expanding arm 33 and the like. Then, the end plate 22*a* of the pivoting base portion 22 pinches the number of containing bags 65 between the end plate 22*a* and the contact plate 56 urged forward by the leaf spring 57 between the two support pins 13, 13.

Under the state, when the lever 29 disposed at the position shown in FIG. 11 is pivoted in the counterclockwise direction, the respective arms 29*d* of the lever 29 are brought into contact with the end edges 26*a* of the respective slits 62 and the lever 29 is stopped to be disposed substantially in a horizontal direction. At this occasion, the expanding arm 33 is pivoted in the clockwise direction against the coil spring 34 by being brought into contact with the end plate 22*a* of the pivoting base portion 22 and is disposed in the vertical direction to be along the end plate 22*a* such that the front end 33*b* is disposed on an upper side of the inserting port 65*a* of the containing bag 65 disposed at the frontmost end.

Hence, when the hand is left from the handle 29*d* of the lever 29, the lever 29 is pivoted in the clockwise direction by its own weight and returns to the position shown in FIG. 11. At this occasion, the expanding arm 33 maintains always the vertical state by operation of the coil spring 34 although the lever main body 29*a* of the lever 29 is brought into an inclined state and therefore, the expanding arm 33 is gradually inserted into the inserting port 65*a* of the containing bag 65 at which the front end 33*b* of the expanding arm 33 is disposed. Therefore, when the state of FIG. 11 is recovered, the expanding arm 33 can expand the inserting port 65*a* to separate the front piece 66 and the rear piece 67 of the containing bag 65.

Hence, when a commodity is thrown in from the opening 27, the commodity is firmly thrown into the containing bag 65. Thereafter, when the containing bag 65 contained with the commodity is pulled downward, the containing bag 65 is cut from the cut line 65*c* of the containing bag 65 and the containing bag 65 can be taken out. Further, in throwing the commodity into the containing bag 65, when the containing bag 65 is cut to be separated from the cut line 65*c* by a weight of the commodity, the commodity is received by the receiving bowl 65 arranged at the lower side of the respective containing bags 65 and the containing bag 65 can be prevented from being dropped. In order to expand a successive one of the containing bag 65, the hand may be left therefrom after pivoting the lever 29 in the counterclockwise direction again.

As explained above, according to the embodiment, when the pivoting base portion 22 is pivoted upward and the containing bag 65 is mounted and the pivoting base portion 22 is recovered to an original state, the containing bag 65 can stably be held by the end plate 22*a* of the pivoting base portion 22. Further, by only pivoting the lever in the counterclockwise direction, the inserting port 65*a* of the containing bag 65 can simply be expanded to open. Therefore, the containing bag 65 can be held or expanded by a small-sized and simple constitution.

Further, the invention is not limited to the above-described embodiments but can variously be changed as necessary.

INDUSTRIAL APPLICABILITY

The commodity containing apparatus of the invention can be utilized when, for example, in order to provide seasonings of sugar and the like or milk packed by a unit of use thereof, these are thrown into the containing bag to contain.

The invention claimed is:

1. A commodity containing apparatus comprising:

a charging member attached to a base portion for charging a plurality of sheets of containing bags, said base portion arranged to be fixed to a counter or the like; and a pivoting base portion pivotably supported by the base portion in a vertical face and formed with an opening for throwing in a commodity at a center portion thereof, wherein an end plate of the pivoting base portion opposed to the charging member presses to hold the plurality of sheets of containing bags; and wherein the pivoting base portion is provided with a lever pivotably supported in a vertical face and an expanding arm inserted into an opening of a frontmost one of the containing bags charged to the charging member for expanding the containing bag when the pivoted lever recovers to an original position by a self weight thereof supported by the lever.

2. The commodity containing apparatus according to claim 1, wherein at least two sheets of end plates surrounding the opening for throwing in the commodity are inclined downward toward a center side.

3. The commodity containing apparatus according to claim 2, further including a holding frame fixed to the base portion and formed with a fold-to-bend portion hung downward in a vertical direction of the base portion and folded to bend in a horizontal direction such that a lowermost portion thereof is disposed downward from the plurality of sheets of containing bags, and a receiving bowl arranged at the fold-to-bend portion of the holding frame.

4. The commodity containing apparatus according to claim 1, further including a holding frame fixed to the base portion and formed with a fold-to-bend portion hung downward in a vertical direction of the base portion and folded to bend in a horizontal direction such that a lowermost portion thereof is disposed downward from the plurality of sheets of containing bags, and a receiving bowl arranged at the fold-to-bend portion of the holding frame.

5. A commodity containing apparatus fixed to a fixing member of a counter or the like of a store for expanding a containing bag and throwing a commodity thereinto to contain, wherein the commodity containing apparatus includes a fixed member fixed to the fixing member, a base portion engaged attachably and detachably to and from the fixing member, a charging member attached to the base portion for charging a plurality of sheets of the containing bags, a pivoting base portion pivotably supported by the base portion in a vertical shape, formed with an opening for throwing in the commodity at a center portion thereof, an end plate thereof opposed to the charging member pressing to hold the plurality of sheets of containing bags, and a lever pivotably supported by the pivoting base portion in a vertical face and arranged with an expanding arm inserted into an opening of a frontmnost one of the containing bag charged to the charging member for expanding the containing bag when the expanding arm is pivoted and thereafter returns to an original position by a self weight thereof.

6. The commodity containing apparatus according to claim 5, wherein the fixed member is formed with a hook portion, a lock shaft extended in a longitudinal direction engaged with the hook portion of the fixed member is movably arranged at the base portion, and the lock shaft is arranged with a spring for providing an elasticity in a direction of the hook portion of the fixed member.

7. The commodity containing apparatus according to claim 6, wherein at least two sheets of end plates surrounding the opening for throwing in the commodity are inclined downward toward a center side.

8. The commodity containing apparatus according to claim 7, further including a holding frame fixed to the base portion and formed with a fold-to-bend portion hung downward in a vertical direction of the base portion and folded to bend in a horizontal direction such that a lowermost portion thereof is disposed downward from the plurality of sheets of containing bags, and a receiving bowl arranged at the fold-to-bend portion of the holding frame.

9. The commodity containing apparatus according to claim 6, further including a holding frame fixed to the base portion and formed with a fold-to-bend portion hung downward in a vertical direction of the base portion and folded to bend in a horizontal direction such that a lowermost portion thereof is disposed downward from the plurality of sheets of containing bags, and a receiving bowl arranged at the fold-to-bend portion of the holding frame.

10. The commodity containing apparatus according to claim 5, wherein at least two sheets of end plates surrounding the opening for throwing in the commodity are inclined downward coward a center side.

11. The commodity containing apparatus according to claim 10, further including a holding frame fixed to the base portion and formed with a fold-to-bend portion hung downward in a vertical direction of the base portion and folded to bend in a horizontal direction such that a lowermost portion thereof is disposed downward from the plurality of sheets of containing bags, and a receiving bowl arranged at the fold-to-bend portion of the holding frame.

12. The commodity containing apparatus according to claim 5, further including a holding frame fixed to the base portion and formed with a fold-to-bend portion hung downward in a vertical direction of the base portion and folded to bend in a horizontal direction such that a lowermost portion thereof is disposed downward from the plurality of sheets of containing bags, and a receiving bowl arranged at the fold-to-bend portion of the holding frame.

13. A commodity containing apparatus comprising:

a charging member attached to a base portion for charging a plurality of sheets containing bags, said base portion arranged to be fixed to a counter or the like;

a pivoting base portion pivotably supported by the base portion in a vertical face and formed with an opening for throwing in a commodity at a center portion thereof, wherein an end plate of the pivoting base portion opposed to the charging member presses to hold the plurality of sheets of containing bags;

a holding frame fixed to the base portion and formed with a fold-to-bend portion hung downward in a vertical direction of the base portion and folded to bend in a horizontal direction such that a lowermost portion thereof is disposed downward from the plurality of sheets of containing bags, and a receiving bowl arranged at the fold-to-bend portion of the holding frame.

14. A commodity containing apparatus comprising:

a charging member attached to a base portion for charging a plurality of sheets of containing bags, said base portion arranged to be fixed to a counter or the like;

a pivoting base portion pivotably supported by the base portion in a vertical face and formed with an opening for throwing in a commodity at a center portion thereof, wherein an end plate of the pivoting base portion opposed to the charging member presses to hold the plurality of sheets of containing bags; and at least two sheets of end plates surrounding the opening for throwing in the commodity are inclined downward toward a center side;

a holding frame fixed to the base portion and formed with a fold-to-bend portion hung downward in a vertical direction of the base portion and folded to bend in a horizontal direction such that a lowermost portion thereof is disposed downward from the plurality of sheets of containing bags, and a receiving bowl arranged at the fold-to-bend portion of the holding frame.

* * * * *